US005819678A

United States Patent [19]

Austin

[11] Patent Number: 5,819,678

[45] Date of Patent: Oct. 13, 1998

[54] BOAT KEEL STABILIZER SYSTEM FOR TROLLING

[76] Inventor: Vincent P. Austin, 1 Russell St., Wallingford, Conn. 06492

[21] Appl. No.: 639,569

[22] Filed: Apr. 29, 1996

[51] Int. Cl.[6] ..... B63B 39/06

[52] U.S. Cl. ..... 114/126

[58] Field of Search ..... 114/126, 132–138, 114/140, 145 A, 145 R

[56] References Cited

U.S. PATENT DOCUMENTS

| | | | |
|---|---|---|---|
| 2,752,874 | 7/1956 | Held | 114/126 |
| 2,807,228 | 9/1957 | Vandre | 114/145 R |
| 5,095,839 | 3/1992 | Peterson | 114/126 |

FOREIGN PATENT DOCUMENTS

| | | | |
|---|---|---|---|
| 100275 | 6/1925 | Austria | 114/126 |

*Primary Examiner*—Ed L. Swinehart
*Attorney, Agent, or Firm*—Our Pal(R) Asija

[57] ABSTRACT

This invention relates to a fold-able panel as keel stabilizer for small boats of up to 20 feet in length approximately during trolling speeds of up to ten miles per hour approximately, such that the same motor can be used for trolling as well as higher speed point to point travel. More particularly it relates to adding a fold-able panel along the side of the boat closer to the transom. The panel when opened or unfolded extends below the bottom of the boat and provides stabilization during trolling. The fulcrum of the panels is generally above the water-line.

10 Claims, 4 Drawing Sheets

BOAT KEEL STABILIZER SYSTEM FOR TROLLING

RELATED DOCUMENT

This invention is based on the concept disclosed and filed under USPTO Disclosure Document Program which was assigned document number 353,399 on May 2, 1994.

1. Background

This invention relates to an improvement in boats. Specifically the invention relates to a keel stabilizer for small boats of up to 20 feet in length approximately during trolling speeds of up to ten miles per hour approximately, such that the same motor can be used for trolling as well as higher speed point to point travel. More particularly it relates to adding a fold-able panel along the side of the boat closer to the transom. The panel when opened or unfolded extends below the bottom of the boat and provides stabilization during trolling and resistance to drifting in windy conditions. The fulcrum of the panels is generally above the water-line.

The panel is closed or folded for towing of the boat. While the keel may be incorporated into OEM boats, the kit also includes means for easily attaching the kit to any boat. In either configuration means are included for easily locking the keel panel in open/unfolded and closed/folded position without any tools or external instrumentalities.

2. Prior Art

A formal preliminary prior art search has not yet been conducted. But the inventor is intimately familiar with the prior art. The best know prior art is U.S. Pat. No. 4,597,348 granted to Otakar Jonas on Jul. 1, 1986 for "Detachable Keel for Small Boats. This device requires detaching the keel from the boat during towing and re-attaching for stabilization during trolling in water. Following are other tangentially related typical examples of the prior art known to the inventor or his attorney arranged in the reverse chronological order.

a) U.S. Pat. No. 4,911,095 awarded to Alex R. Caye on Mar. 27, 1990 for "Collapsible Boat with Removable Transom panel."

b) U.S. Pat. No. 4,776,295 granted to Allen J. Kline on Oct. 11, 1988 for "Boat Flaps for Controlling and Steering a Boat Operating and Low Speeds"

c) U.S. Pat. No. 4,556,009 granted to Alex R. Caye on Dec. 3, 1985 for "Boat with Stabilizing Flaps"

d) U.S. Pat. No. 4,451,989 conferred upon Lawrence F. Leisstiko on Jun. 5, 1984 for "Boat Keel Tool"

e) U.S. Pat. No. 3,633,531 granted to Thomas A. Hays on Jan. 11, 1972 for "Trolling Device for Boats"

Unfortunately none of the prior art devices singly or even in combination meet all of the objectives established by the inventor for this Add-a-Keel Boat stabilizer.

OBJECTIVES

1. It is an objective of this invention to provide an improved boat incorporating a simple affordable system for stabilizing small boats during trolling or windy conditions.

2. Another objective of this invention is to provide a means for incorporating the device into OEM boats.

3. Another objective of this invention is to provide a means for easily incorporating this device into existing boats.

4. Another objective of this invention is that the device of this invention not interfere with normal towing of the boat.

5. Another objective of this invention is to provide a means for easily switching the position of the keel to extend below bottom of boat during trolling or whenever in the water and above bottom of boat during towing.

6. Another objective of this invention is that it be safe stable and reliable.

7. Another objective of this invention is that it be ergonomically designed, environmentally friendly and aesthetically integrated.

8. Another objective of this invention is that it is easily serviceable.

9. Another objective of this system is that the user cannot accidentally destroy or even damage it.

10. Another objective of this invention is that it provides versatility and variety.

11. Another objective of this invention is that it be long lasting and reliable.

12. Another objective of this invention is that it meet all federal, state, local and other private standards and regulations with respect to safety, environment, energy consumption, noise etc. etc.

13. Another objective of this invention is that it obviate waste of any type.

14. Another objective of this invention is that it not interfere with normal functions of the boat or the boater.

15. Another objective of this invention is that it be adaptable for other primary and secondary uses without significant modifications.

16. Another objective of this invention is that it can be adapted for used by physically challenged users.

17. Another objective of this invention is that the keel be self locking in both open and closed positions thereby obviating an external lock.

18. Another objective of this invention is to reduce the effect of wind when the boat is lying still on the water.

Other objectives of this invention reside in its simplicity, elegance of design, ease of manufacture, service and use and even aesthetics as will become apparent from the following brief description of the drawing and detailed description of the best mode embodiment.

BRIEF DESCRIPTION OF THE DRAWING

The objects, features and advantages of the present invention and its application will be more readily appreciated when read in conjunction with the accompanying drawing, in which.

a)

b)

c)

d)

e)

f)

g)

Figure 8:
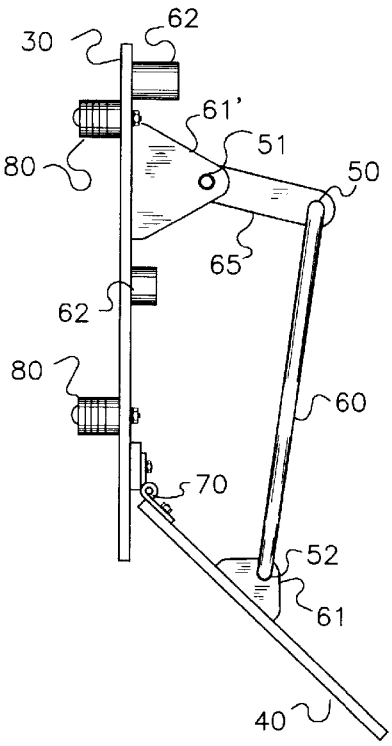
Figure 9:
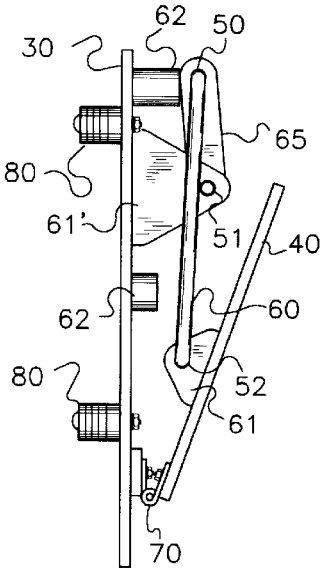
Figure 10:
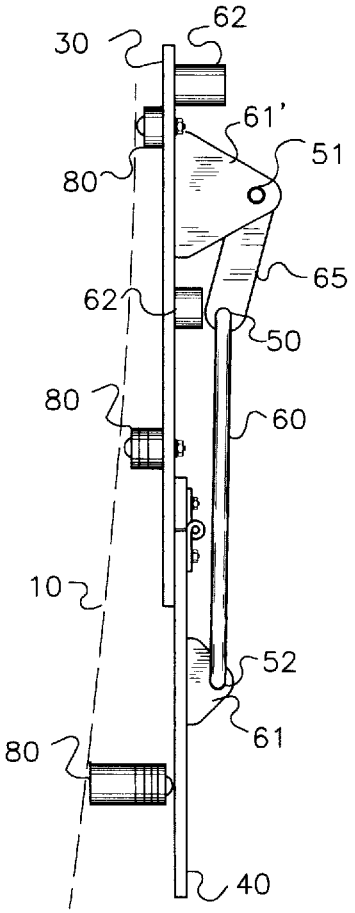

h) FIG. 8 show the keel in partially closed position.

i) FIG. 9 shows the keel in the locked position.

j) FIG. 10 shows the keel boat interface via spacers to account for the slope on the side of the boat.

DETAILED DESCRIPTION OF THE BEST MODE EMBODIMENT

As shown in the drawings wherein like numerals represent like parts throughout the several views, there is generally disclosed a fold-able Add-a Keel stabilizer 20, on a boat 10. An embodiment of this invention comprises adding a fold-able panel 40 or a pair of panels 30,40 with a fulcrum 70 or equivalent flaps as keel on the side of the boat near the transom. The panel 40 is generally larger in area than panel 30. The panel 40 can be made even longer, larger and heavier by utilizing the existing hinge fulcrum 70. The panel 40 when opened or unfolded extends below the bottom of the boat 10 and provides stabilization during trolling or in windy conditions.

The fulcrum 70 is below the water line on the boat 10 so as to ensure that the lower flap 40 when in the open position extends below the bottom of the boat. The water-line on any boat varies according to the weight. The upper panel 30 is generally stationary. The lower panel 40 is generally fold-able and moveable. In either configuration means are included for automatically locking the keel panel in open/unfolded and closed/folded position without any tools or external instrumentalities.

The folding and unfolding is facilitated by a U shaped connecting member 60 which is interfaced to lower moveable panel at anchor 61 and to fixed upper panel at anchor 61' through a hinge-able member 65.

For safety and ease of use hinge-able member 65 friction or grip fits into member 62 in two positions one corresponding to the folded position and the other corresponding to the open or extended position of the flaps or panels 30,40. This locking position is achieved.

This is accomplished when the member 65 travels beyond the vertical or beyond 180 degrees such that fulcrum 50 is below and beyond fulcrum 51.

In other words when the fulcrum 50 goes past the imaginary line formed by fulcrums 51 and 52, the member 65 locks in either the upper or the lower position. It should also be noted that whenever member 65 is down, the panel 40 is also down and vice versa.

The combination of members 62 and 65 facilitates locking of the panels in open and closed position automatically thereby obviating the need for an external lock. The panel 40 when opened or unfolded extends below the bottom of the boat 10 and provides stabilization during trolling and windy conditions.

The panel is closed or folded for towing of the boat. The DIY (Do-It-Yourself) kit also includes OEM double sided sticky tape as a means for easily attaching the kit to any boat as well as spacers 80 for snug interface between the panels 30, 40 and the boat 10. Spacers may be modular and circular shaped washers of varying thickness or they may be long and tapered to more readily follow contour of the boat.

In either configuration a OEM or DIY Kit snap fastener, a friction fit member or other equivalent means which perform the same function in substantially the same manner with substantially the same result of securing the panel in open and closed position are included for easily locking the keel panel in open/unfolded and closed/folded position without any tools or external instrumentalities.

The fold-able keel in turn comprises a stationary panel 30 and an extendable panel 40. The stationery panel 30 is generally smaller in area and generally triangular. The moveable panel 40 is generally larger and rectangular.

The stationary panel 30 is affixed to the boat with double sticky 3M OEM tape or screws or the like device. The extendible panel has curved edges or rounded corners 42 so as to minimize air resistance during towing in folded position and to prevent accumulation of pond weeds in the unfolded position in the water.

Figure 2:
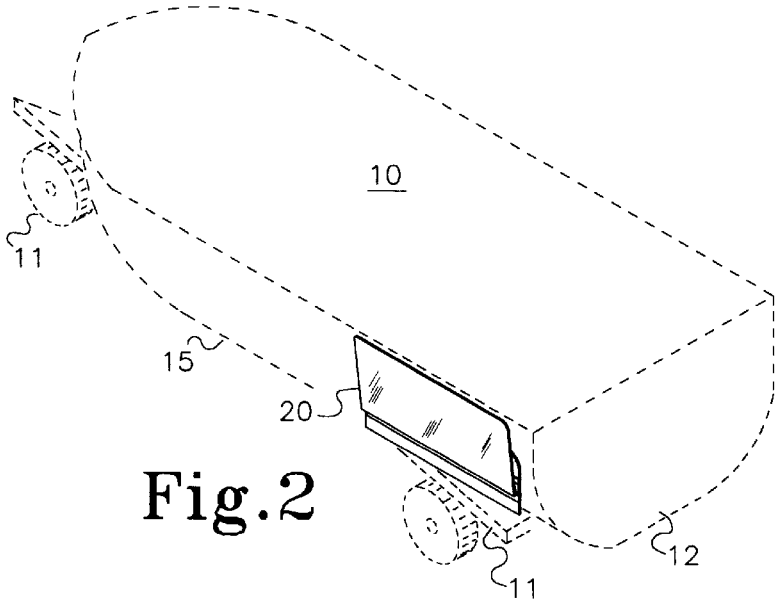
FIG. 2 is a perspective view of the boat on a trailer on the ground with keel in the folded position as attached to the boat.
Figure 1:
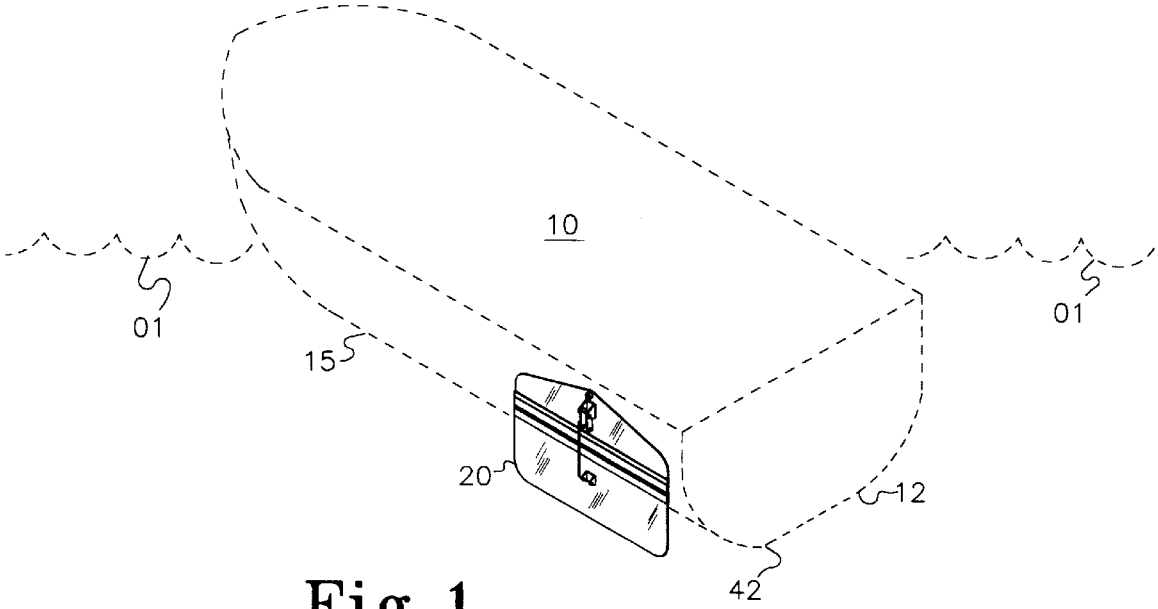
FIG. 1 is a perspective view of the boat in the water with keel in the open position wherein the fulcrum of the panels is below the water line and the bottom moveable panel extends below the bottom of the boat.
Figure 3:
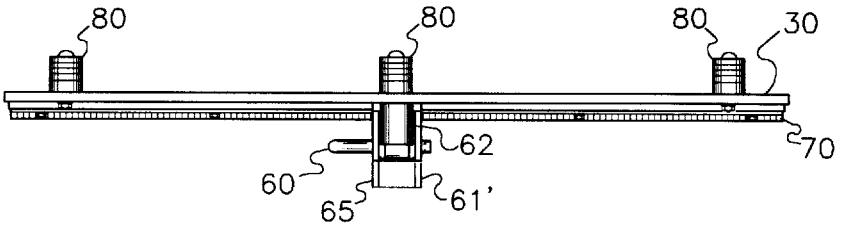
FIG. 3 is a top elevations of the keel.
Figure 4:
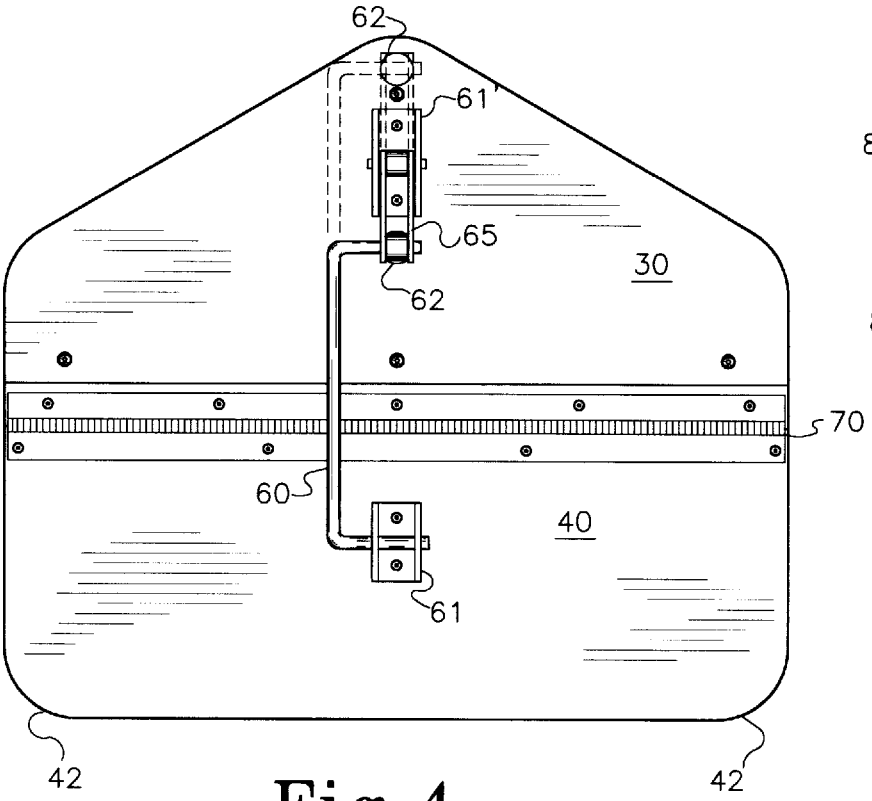
FIG. 4 is a front elevation thereof.
Figure 6:
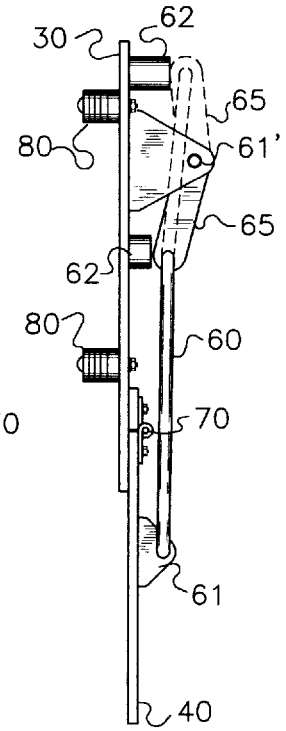
FIG. 6 is a side elevation thereof.
Figure 5:
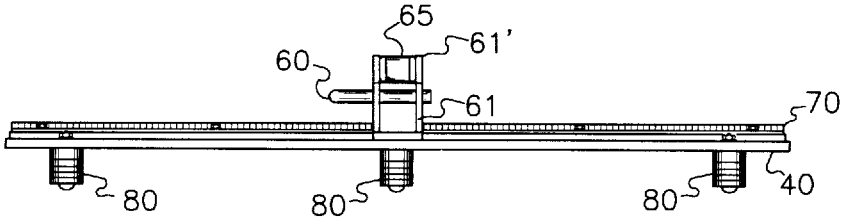
FIG. 5 is bottom elevation thereof.
Figure 7:
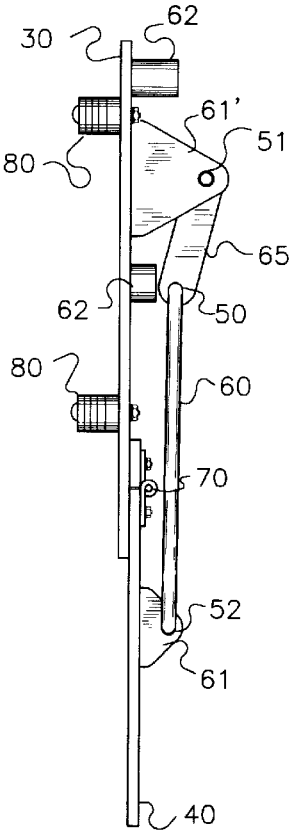
FIG. 7 shows the keel in fully extended locked position.

Hinge 70 connects the two panels 30 and 40 which need not be equal and may have an additional fold-able line as fulcrum 70 between the two panel 30 and 40. Also included is an arm 60 connected to the fold-able panel 40 and stationary panel 30 via member lock-able member 65. As shown in FIGS. 7 & 9, the arm 60 can be anchored at two positions 62 on the boat for flaps in open and closed position respectively.

OPERATION

The device is easy to install and use. To install merely attach the fixed keel panel to the side of the boat near the transom with screws or OEM approved 3M Double sided sticky tape provided for the purpose in the kit. The arm to the extendible panel, the fasteners respectively to the boat and the panels in their natural closed and open positions.

To use the keel close the panel in the folded position during towing and in the open or unfolded position during trolling, windy conditions or when lying still in the water.

To close the keel the user simply holds the U shaped connecting rod 60 as if it were a handle and moves it out and up until member 65 self locks in the vertical position.

To open the keel the user merely pulls out the U shaped connecting rod member 60 and down into a vertical position till the member 65 self locks in the downward position. Again it should be noted that whenever member 65 is down the panel 40 is also down and vice versa.

DEFINITIONS

Great care has been taken to use words with their conventional dictionary definitions. Following definitions are included here for clarification.

Interface=Relationship between two entities.

DIY=Do It Yourself

Gunwale=Upper rim of Boat (Note: Gunwale is Pronounced Gunnel)

OEM=Original Equipment Manufacturer

TRANSOM=A transverse beam fixed across the stern post of a ship.

The inventor has given a non-limiting description of the concept. Many changes may be made to this design without deviating from the spirit of the concept of the invention. Examples of such contemplated variations include the following.

a) The keel may be positioned differently on the boat.

b) The various flaps of the keel may be proportioned and sized differently.

c) A different opening and closing mechanism may be employed.

d) A different method of attachment of the keel may be employed.

e) The device may be adapted for other related angling applications.

f) A different OEM version may be devised.

g) shape of the flaps may be changed.

h) A fold-able single flap or a pair of flaps may be employed.

i) Folding line fulcrum's position may be changed.

j) Relationship of water-line to fulcrum or to bottom of the boat may be varied.

k) A different self locking means may be employed.

l) The spacers may be in the form of modular circular washers of varying thickness or in the form of strips of varying thickness to more readily conform to the contours of the boat.

Other changes such as aesthetic and substitution of newer materials as they become available which substantially perform the same function in substantially the same manner with substantially the same result without deviating from the spirit of this invention may be made.

Following is a listing of the components used in this embodiment arranged in ascending order of the reference numerals for ready reference of the reader.

01=Water or Water-line

10=Boat

11=Boat Trailer

12=Transom (AFT) of boat of boat

15=Bottom of Boat

20=Keel generally

30=Fixed Panel or un-fold-able portion thereof

40=Extendible Keel panel

42=Curved streamlined corners of extendible panel

50=Fulcrum between members 60 and 65

51=Fulcrum between member 65 and anchor 61' on upper stationary panel.

52=Fulcrum between member 60 and anchor 61 on lower moveable panel.

60=U shaped Arm or Handle Member

61=Anchor on lower moveable panel

61'=Anchor on Upper Stationery Panel

62=Arm interface to stationary upper panel

65=A link member between arm 60 and interface 62

70=Optional fulcrum in panels

80=Panel boat interface spacers

While this invention has been described with reference to illustrative embodiments, this description is not intended to be construed in a limiting sense. Various modifications and combinations of the illustrative embodiments as well as other embodiments of the invention will be apparent to person skilled in the art upon reference to this description. It is therefore contemplated that the appended claims will cover any such modifications, embodiments as fall within the true scope of the invention.

I claim:

1. An improved boat having a keel stabilizer to the side of a boat comprising:

a) a boat;

b) a pair of fold-able flaps having a fulcrum, connected to the side of the boat near transom; and c) a U shaped arm means for opening, closing and securing said pair of flaps in open and closed vertical positions, said U shaped arm being connected to said pair of fold-able flaps.

2. The improved boat having a keel stabilizer of claim 1 positioned on the boat wherein the water line is above the fulcrum of said pair of fold-able flaps and the lower flap in open position extends below the bottom of the boat.

3. The improved boat having a keel stabilizer of claim 1 where in said pair of flaps comprises a rigid upper flap and a rigid lower flap connected by a hinge at said fulcrum of said pair of flaps and wherein said upper flap is triangular in shape and said lower flap is rectangular in shape and wherein said lower flap is larger and heavier than said upper flap.

4. The improved boat having a keel stabilizer of claim 3 wherein said U shaped arm means for opening, securing and closing acts as a handle which is self locking in two positions one each corresponding to folded and open positions of said pair of flaps.

5. The improved boat having a keel stabilizer of claim 3 wherein said lower flap is characterized by curved streamlined corners.

6. An improvement in a boat with stabilization means for trolling wherein said stabilization means comprises:

a) a fold-able panel having a fulcrum connected to the side of the boat near transom; and b) a U shaped arm connected to said fold-able panel on two points; and wherein said U shaped arm acts as a means for opening, closing and securing said fold-able panel in open and closed vertical positions.

7. The improved boat with high stabilization trolling means of claim 6 positioned on the boat wherein the water line is above the fulcrum of said fold-able panel and the lower end of said panel in open position extends below the bottom of the boat.

8. The improved boat with high stabilization trolling means of claim 6 where in said fold-able panel comprises a rigid upper panel and a rigid lower panel connected by a hinge at fulcrum of said fold-able panel and wherein said upper panel is triangular in shape and said lower panel is rectangular in shape and wherein said lower panel is larger longer and heavier than said upper panel.

9. The improved boat with high stabilization for trolling means of claim 8 wherein said U shaped arm is self locking in two positions one each corresponding to folded and open positions of said fold-able panel.

10. The add-on-keel stabilizer of claim 8 wherein said lower panel is characterized by curved streamlined corners.

* * * * *